US008506057B2

(12) United States Patent
Hirai

(10) Patent No.: US 8,506,057 B2
(45) Date of Patent: Aug. 13, 2013

(54) LIQUID DROPLET EJECTING HEAD AND LIQUID DROPLET EJECTING APPARATUS

(75) Inventor: Eiju Hirai, Minamiminowa-mura (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 12/905,470

(22) Filed: Oct. 15, 2010

(65) Prior Publication Data

US 2011/0090291 A1 Apr. 21, 2011

(30) Foreign Application Priority Data

Oct. 16, 2009 (JP) ..... 2009-239335

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS 8,029,109 B2 * 10/2011 Yazaki ..... 347/68
2009/0284568 A1 11/2009 Yazaki

FOREIGN PATENT DOCUMENTS

JP 2009-172878 8/2009

* cited by examiner

*Primary Examiner* — Matthew Luu
*Assistant Examiner* — Erica Lin
(74) *Attorney, Agent, or Firm* — Workman Nydegger

(57) ABSTRACT

A liquid droplet ejecting head including a pressure chamber substrate that is provided with a pressure chamber communicating with a nozzle orifice, an oscillating plate formed over the pressure chamber at a first area surface; a plurality of first conductive layers formed over the oscillating plate which completely overlap and extend beyond the first area surface; a piezoelectric layer formed over the first conductive layers so as to overlap at least over the first area surface; and a second conductive layer, which is continuously formed so as to cover the piezoelectric layer and completely overlap and extend beyond the first area surface at extending portions, which extend in at least a part of an area between the first conductive layers adjacent to each other.

6 Claims, 12 Drawing Sheets

LIQUID DROPLET EJECTING HEAD AND LIQUID DROPLET EJECTING APPARATUS

CROSS-REFERENCES AND RELATED APPLICATIONS

The entire disclosures of Japanese Patent Application No. 2009-239335, filed Oct. 16, 2009 is expressly incorporated herein by reference.

BACKGROUND OF THE INVENTION

1. Technical Field

The present invention relates to a liquid droplet ejecting head and a liquid droplet ejecting apparatus. More specifically, the present invention relates to a piezoelectric element for a liquid droplet ejecting head and a liquid droplet ejecting apparatus with improved durability.

2. Related Art

In liquid droplet ejecting apparatuses currently known in the art, such as ink jet printers, there are liquid droplet ejecting heads equipped with piezoelectric elements which are configured to eject liquid droplets of ink or the like. The liquid droplet ejecting heads change the pressure within a pressure chamber formed below an oscillating plate by allowing the piezoelectric element to change the shape of the oscillating plate in response to driving signals and the like. With such a configuration, it is possible to eject liquid droplets supplied through nozzle orifices into the pressure chamber. In some configurations, the liquid droplet ejecting have having a structure in which a piezoelectric layer is covered by an upper electrode in order to protect the piezoelectric layer of the piezoelectric element which is often subject to deterioration due to external factors such as humidity (for example, see Japanese Patent Document JP-A-2009-172878 (FIG. 2)).

In the case where the upper electrode structure of the piezoelectric element is adopted as disclosed in JP-A-2009-172878, when the piezoelectric layer is deformed by applying a voltage to the lower electrode and the upper electrode, the opposing upper electrode is stressed by the piezoelectric layer. As viewed from the longitudinal direction of the piezoelectric element, one end of the upper electrode is formed as a free end, while the other end thereof extends up to the outside of the pressure chamber or the piezoelectric body. Therefore, the unbalanced stress is caused by the both ends of the active area defined as an area in which the upper electrode and the lower electrode overlap with each other. Thus there is a problem in that crack tends to occur particularly at the free end side thereof in view of durability.

BRIEF SUMMARY OF THE INVENTION

An advantage of some aspects of the invention is to provide a liquid droplet ejecting head and a liquid droplet ejecting apparatus having improved durability.

An aspect of the invention is a liquid droplet ejecting head comprising a pressure chamber substrate provided with a pressure chamber communicating with a nozzle orifice, wherein a plurality of the pressure chambers are arranged on the pressure chamber substrate in a first direction, an oscillating plate that has a first surface and a second surface opposed to the first surface, wherein the first surface covers the pressure chamber as viewed from a second direction which is orthogonal to the first direction and is a normal direction of the first surface, a plurality of first conductive layers formed, as viewed from the second direction, to cover the second surface of the oscillating plate within an area overlapping with the first area surface in the first direction, and to cover the second surface of the oscillating plate by extending up to the outside of the area overlapping with the first area surface on at least one side in a third direction orthogonal to the first direction and the second direction, a piezoelectric layer formed, as viewed from the second direction, to cover the first conductive layer in at least the area overlapping with the first area surface, and a second conductive layer continuously formed, as viewed from the second direction, to cover the piezoelectric layer in the first direction at least within the area overlapping with the first area surface, and being formed to cover at least a part of the piezoelectric layer while overlapping with a part of the plurality of first conductive layers in the third direction, and having, as viewed from the second direction, extending portions, which extend toward both sides in the third direction, in at least a part of an area between adjacent first conductive layers.

According to the aspect of the invention, as viewed from the second direction, the extending portions, which extend toward both sides in the third direction, are provided in at least a part of the area between the first conductive layers adjacent to each other. Hence, it becomes easy to adjust the balance of stiffness in the third direction. Accordingly, it is possible to embody a liquid droplet ejecting head having improved durability.

DESCRIPTION OF EXEMPLARY EMBODIMENTS

Hereinafter, preferred embodiments of the invention will be described with reference to the accompanying drawings. In addition, the invention is not limited to the embodiments described herein. Further, not all of the components to be described below are essential components of the invention described in the claims appended hereto and their descriptions are not intended to limit the scope of the claims.

1. Liquid Droplet Ejecting Head 1-1. Structure

Hereinafter, a structure of a liquid droplet ejecting head according to an embodiment will be described with reference to the accompanying drawings.

In addition, in the description relating to the embodiment, the term "above" is used as the following example: "above the specific object (hereinafter referred to as "A"), another specific object (hereinafter referred to as "B") is formed". In the description relating to the embodiment, in the above-mentioned exemplary case, the term "above" is defined to include the case where B is formed directly above A and the case where B is formed above A with another object interposed therebetween. Likewise, the term "below" is defined to include the case where B is formed directly below A and the case where B is formed below A with another object interposed therebetween.

Figure 1:
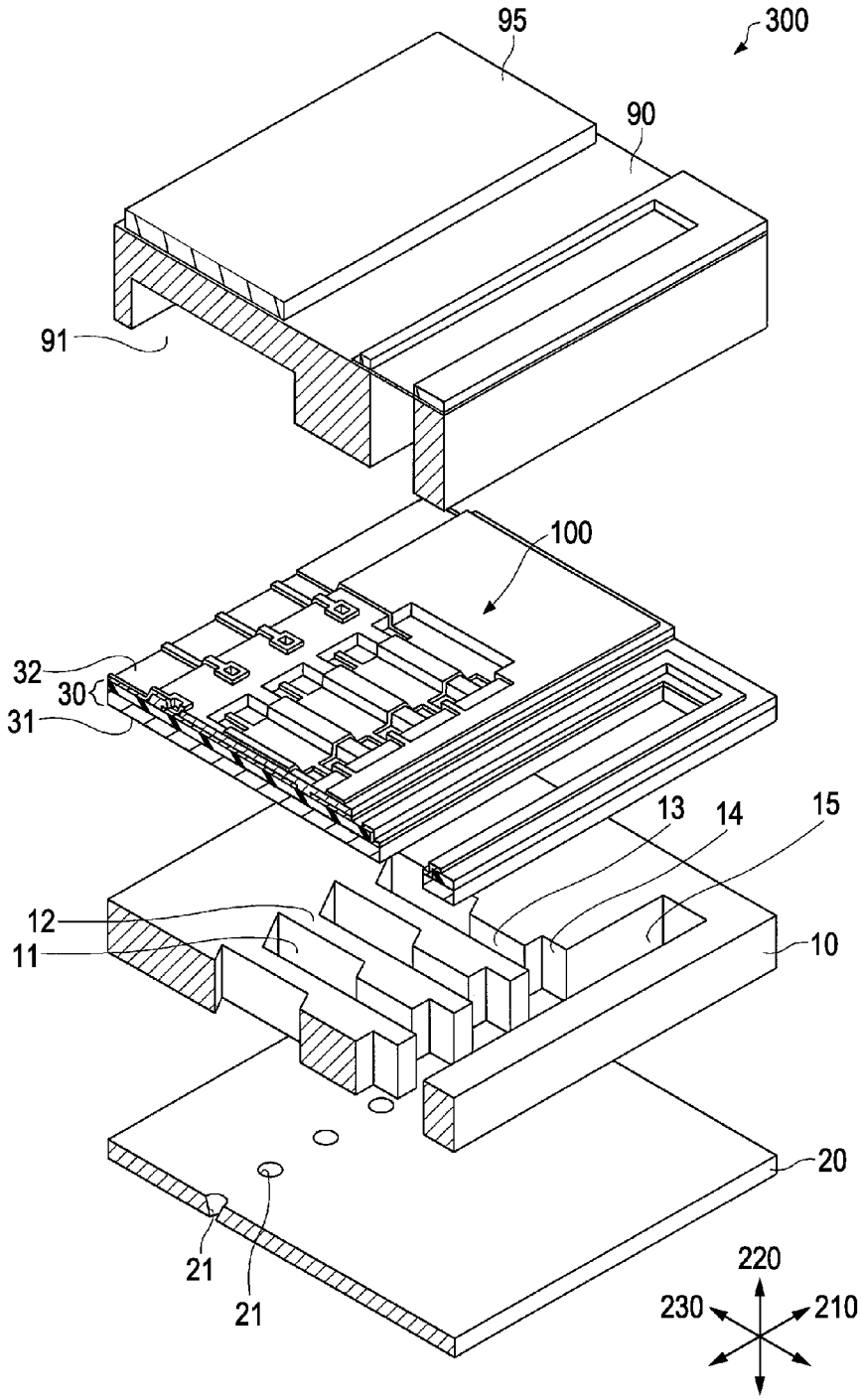
FIG. 1 is an exploded perspective view schematically illustrating a liquid droplet ejecting head according to a first embodiment of the invention.

FIG. 1 is an exploded perspective view of a liquid droplet ejecting head 300 according to a first embodiment of the invention.

As shown in FIG. 1, the liquid droplet ejecting head 300 according to the embodiment includes: a pressure chamber substrate 10 that has pressure chambers 11; an oscillating plate 30 that is formed above the pressure chamber substrate 10; a piezoelectric element 100 that is formed above the oscillating plate 30; a nozzle plate 20 that is formed below the pressure chamber substrate 10; and a sealing plate 90 that seals the piezoelectric element 100.

In the following description, the direction of arranging the pressure chambers 11 is defined as a first direction 210, the normal direction of the first surface 31 of the oscillating plate 30 orthogonal to the first direction 210 is defined as a second direction 220, and the direction orthogonal to the first direction 210 and the second direction 220 is defined as a third direction 230. Here, the term "above" and "below" is defined by the up and down directions of the second direction 220.

The pressure chamber substrate 10 has the pressure chamber 11 which communicates with a nozzle orifice 21 as shown in FIG. 1. The pressure chamber substrate 10 has a plurality of pressure chambers 11 arranged thereon in the first direction 210. As shown in FIG. 1, the pressure chamber substrate 10 has wall portions 12 each constituting a side wall of the pressure chamber 11. Further, the pressure chamber substrate 10 may have a reservoir 15 which communicates with the pressure chambers 11 through supply passages 13 and communication passages 14. In the reservoir 15, a through hole, which is not shown, may be formed, and the reservoir 15 may be supplied through the through hole with liquid and the like.

Herein, the term "liquid" includes not only liquids but also fluids and the like in which various functional materials are adjusted to an appropriate viscosity by using solvating media and dispersion media or which include metal flakes. With such a configuration, by supplying the reservoir 15 with the liquid and the like, it is possible to supply each pressure chamber 11 with the liquid and the like through each supply passage 13 and each communication passage 14. The shape of the pressure chamber 11 is not particularly limited. For example, the shape of the pressure chamber 11 may be formed in a parallelogram shape or in a rectangular shape as viewed form the second direction 220. The number of pressure chambers 11 is not particularly limited, and thus one pressure chamber 11 may be used, or a plurality of pressure chambers may be used. The material of the pressure chamber substrate 10 is not particularly limited. For example, the pressure chamber substrate 10 may be made of monocrystal silicon, nickel, stainless, stainless steel, glass ceramics, various resin materials, and the like.

The nozzle plate 20 is formed below the pressure chamber 10 as shown in FIG. 1. The nozzle plate 20 is a plate-like member and has nozzle orifices 21. The nozzle orifices 21 are formed to communicate with the pressure chambers 11. The shape of each nozzle orifice 21 is not particularly limited if only liquid and the like can be discharged as liquid droplets. Through the nozzle orifice 21, the liquid within the pressure chamber 11 and the like can be discharged, for example, downward below the nozzle plate 20. Further, the number of nozzle orifices 21 is not particularly limited, and thus one nozzle orifice 21 may be used, or a plurality of nozzle orifices 21 may be used. The material of the nozzle plate 20 is not particularly limited. For example, the nozzle plate 20 may be made of monocrystal silicon, nickel, stainless, stainless steel, glass ceramics, various resin materials, and the like.

The oscillating plate 30 is formed above the pressure chamber substrate 10 as shown in FIG. 1. Accordingly, the oscillating plate 30 is formed above the pressure chamber 11 and the wall portion 12. The oscillating plate 30 is a plate-like member. The oscillating plate 30 has a first surface 31 and a second surface 32 (which is the back surface when the first surface 31 is defined as the front surface) opposed to the first surface 31. The oscillating plate 30 covers the pressure chamber substrate 10 by the first surface 31. The structure and the material of the oscillating plate 30 are not particularly limited. For example, the oscillating plate 30 may be formed, as shown in FIG. 1, as a plurality of laminated films. For example, the oscillating plate 30 may be the plurality of laminated films formed of insulation films of zirconium oxide, silicon oxide, and the like, metal films of nickel and the like, and polymer films of polyimide and the like. The oscillating plate 30 constitutes an oscillating section. In other words, by displacement of the later described piezoelectric element 100, the oscillating plate 30 can be oscillated (deformed). Thereby, it is possible to change the volume of each pressure chamber 11 which is formed on the lower side of the ejecting head.

The piezoelectric element 100 of the liquid droplet ejecting head 300 according to the embodiment is formed on the second surface 32 of the oscillating plate 30 as shown in FIG. 1. The piezoelectric element 100 of the liquid droplet ejecting head 300 according to the embodiment is described in more detail below.

Figure 2A:
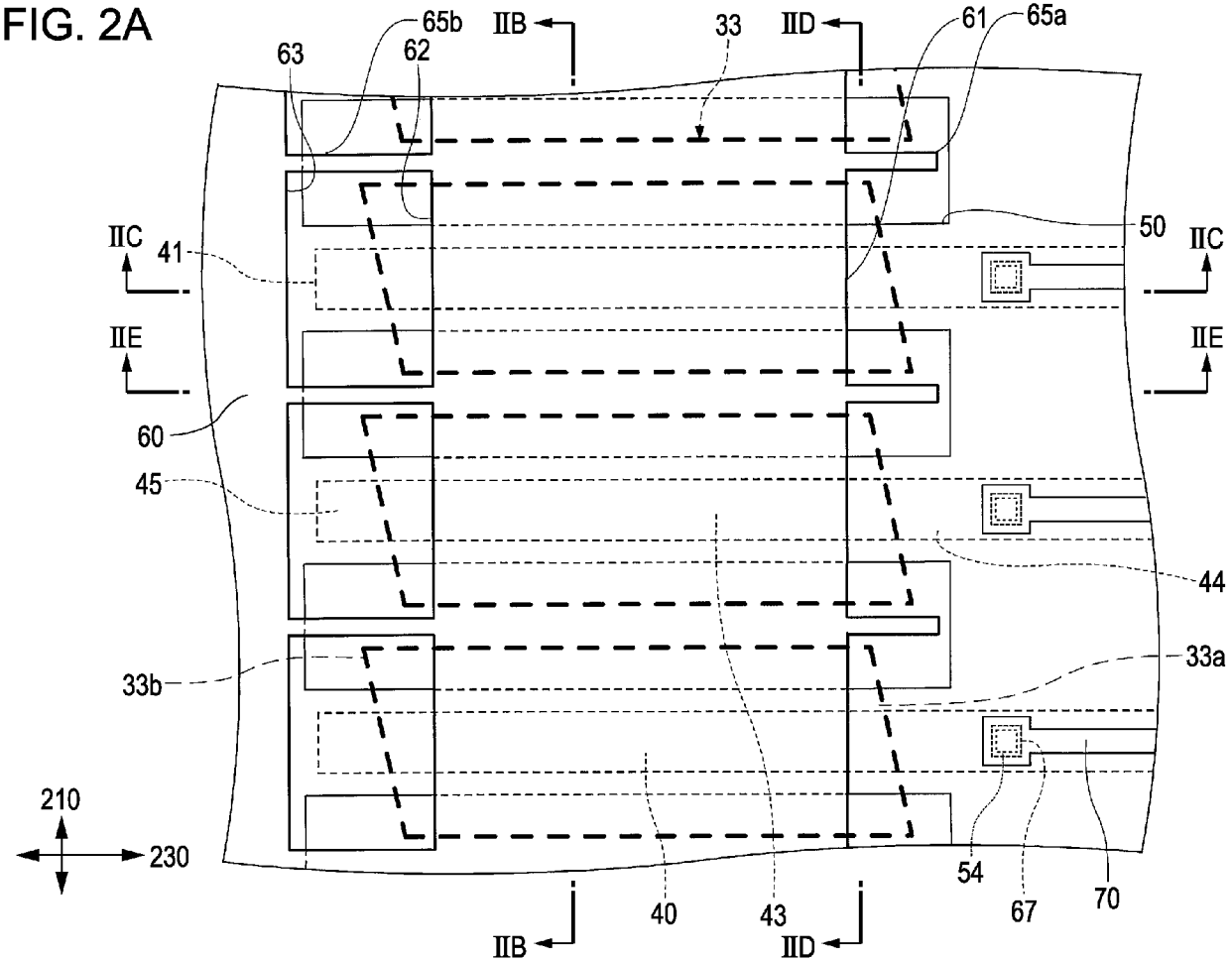
FIG. 2A is a top plan view schematically illustrating principal sections of the liquid droplet ejecting head according to the first embodiment.
Figure 2B:
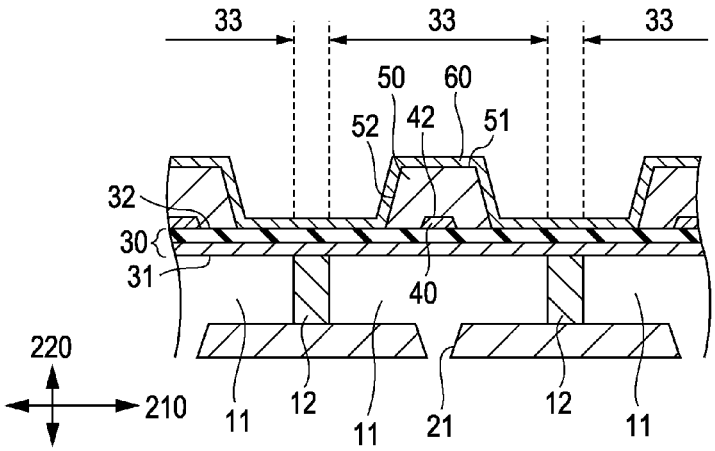
FIG. 2B is a sectional view schematically illustrating the principal sections taken along IIB-IIB line of FIG. 2A.
Figure 2C:
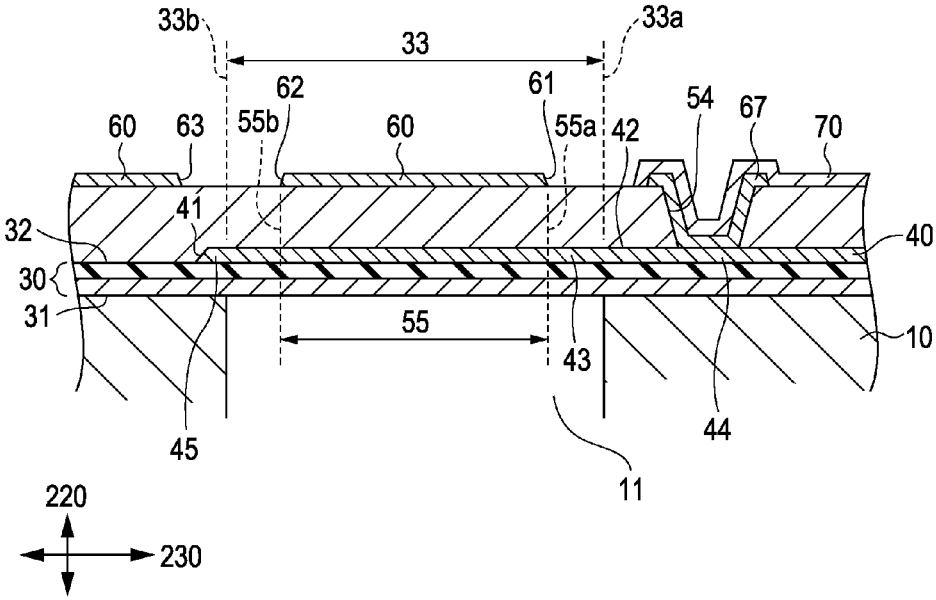
FIG. 2C is a sectional view schematically illustrating the principal sections taken along IIC-IIC-line of FIG. 2A.
Figure 2D:
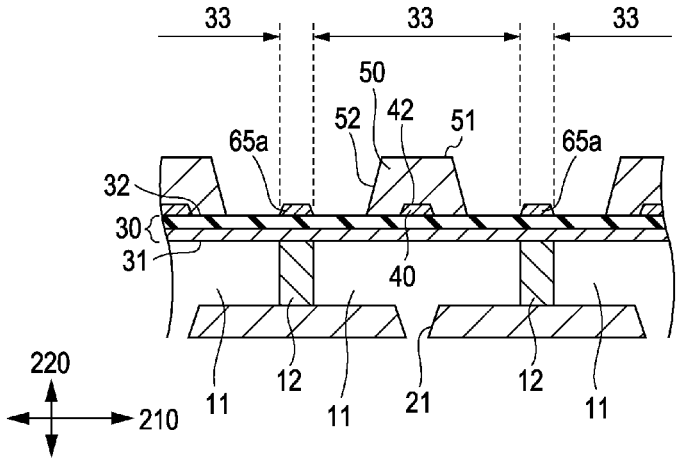
FIG. 2D is a sectional view schematically illustrating the principal sections taken along IID-IID-line of FIG. 2A.
Figure 2E:
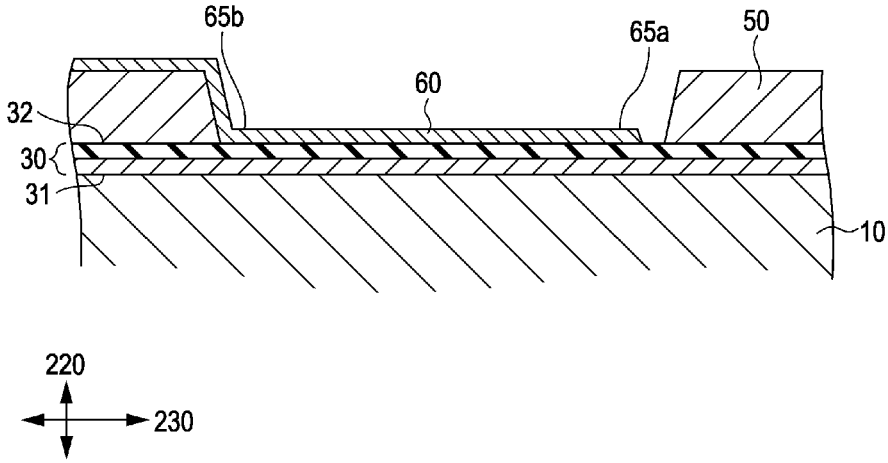
FIG. 2E is a sectional view schematically illustrating the principal sections taken along IIE-IIE-line of FIG. 2A.

FIG. 2A is a top plan view schematically illustrating only the pressure chamber substrate 10, the oscillating plate 30, and the piezoelectric element 100 which are principal sections of the liquid droplet ejecting head 300. FIG. 2B is a sectional view of the principal sections taken along IIB-IIB line of FIG. 2A. FIG. 2C is a sectional view of the principal sections taken along IIC-IIC-line of FIG. 2A. FIG. 2D is a sectional view of the principal sections taken along IID-IID-line of FIG. 2A. FIG. 2E is a sectional view of the principal sections taken along IIE-IIE-line of FIG. 2A.

Hereinafter, the structure of the piezoelectric element 100 is described in detail. As shown in FIGS. 2A to 2E, the piezoelectric element 100 includes a first conductive layer 40, a piezoelectric layer 50, and a second conductive layer 60.

As shown in FIGS. 2A and 2B, the oscillating plate 30 is formed to have a first area surface 33, which covers the pressure chamber 11, on the first surface 31 as viewed from the second direction 220. In the embodiment, as shown in FIGS. 2A and 2B, the first area surface 33 overlaps with the pressure chamber 11 as viewed from the second direction 220. Further, as shown in FIGS. 2A and 2B, the first area surface 33 is formed for each pressure chamber 11.

A plurality of first conductive layers 40 are formed, as viewed from the second direction 220, so as to cover the second surface of the oscillating plate 30 within areas overlapping with the first area surfaces 33 in the first direction 210, and so as to cover the second surface of the oscillating plate 30 by extending beyond the areas overlapping with the first area surfaces 33 on at least one side in the third direction 230.

In the embodiment, as shown in FIGS. 2A and 2C, each first conductive layer 40 has, as viewed from the second direction 220, a sectional surface 41 which is a sectional surface on one side in the third direction 230 beyond the area overlapping with the first area surface 33. The sectional surface 41 is a side surface of the first conductive layer 40 in the third direction 230. The sectional surface 41 may be a tapered side surface. Further, although not shown in the drawing, the sectional surface 41 may be, as viewed from the second direction 220, formed in the area overlapping with the first area surface 33. Further, in the embodiment, as shown in FIGS. 2A and 2B, the first conductive layer 40 has both end portions in the first direction 210 within the area overlapping with the first area surface 33 as viewed from the second direction 220. Further, in the embodiment, as shown in FIGS. 2A and 2C, the first conductive layer 40 has a surface 42.

As shown in FIGS. 2A and 2C, as viewed from the second direction 220, the first conductive layer 40 is formed of: a first conductive portion 43 that is formed in the area overlapping with the first area surface 33; a second conductive portion 44 that extends successively from the inside of the area overlapping with the first area surface 33 to an area beyond the first side 33*a* which is defined as the boundary therebetween; and a third conductive portion 45 that extends successively from the inside of the area which overlaps with the first area surface 33 to beyond the area where the first side 33*b* defines as another boundary. Accordingly, when the sectional surface 41 is formed, as viewed from the second direction 220, out of the area overlapping with the first area surface 33, the sectional surface 41 is the end portion of the third conductive portion 45. Further, when the sectional surface 41 is formed, as viewed from the second direction 220, within the area overlapping with the first area surface 33, the sectional surface 41 is the end portion of the first conductive portion 43. The first conductive layer 40 constitutes a lower electrode in the piezoelectric element 100.

The structure and material of the first conductive layer 40 are not particularly limited. For example, the first conductive layer 40 may be formed as a single layer. Alternatively, the first conductive layer 40 may be formed as a plurality of laminated films. The first conductive layer 40 may be, for example, a metal layer including any of platinum (Pt), iridium (Ir), gold (Au), and the like or a conductive oxide electrode of $LaNiO_3$, $SrRuO_3$, or the like.

The piezoelectric layer 50 is formed to cover the first conductive layer 40 at least within the area overlapping with the first area surface 33 as viewed from the second direction 220. In the embodiment, as shown in FIGS. 2A and 2B, the piezoelectric layer 50 has both end portions in the first direction 210 within the area overlapping with the first area surface 33 as viewed from the second direction 220. Consequently, the piezoelectric layer 50 has a width larger than that of the first conductive layer 40, and a width smaller than that of the first area surface 33, in the first direction 210. As shown in FIGS. 2A and 2C, the piezoelectric layer 50 is formed to cover the second conductive portion 44 and the third conductive portion 45 of the first conductive layer 40 by continuously extending along the third direction 230 even beyond the area overlapping with the first area surface 33 as viewed from the second direction 220. The shape of the piezoelectric layer 50 is not limited, but for example as shown in FIGS. 2A and 2B, may have a surface 51 above the first conductive layer 40, and may have a tapered side surface 52 connected to the surface 51. Further, for example as shown in FIGS. 2A and 2B, as viewed from the second direction 220, an area where the piezoelectric layer 50 does not exist may be provided in at least a part of the area between adjacent first area surfaces 33.

The piezoelectric layer 50 is made of polycrystal having piezoelectric characteristics, and thus can be oscillated by applying a voltage to the piezoelectric element 100. The structure and material of the piezoelectric layer 50 is not particularly limited so long as it has piezoelectric characteristics. The piezoelectric layer 50 may be made of known piezoelectric materials. For example, lead zirconate titanate ($Pb(Zr,Ti)O_3$), sodium bismuth titanate ($(Bi,Na)TiO_3$), and the like may be used.

Further, the piezoelectric layer 50 may have, as shown in FIGS. 2A and 2C, an opening portion 54, by which a part of the second conductive portion 44 is exposed, on the second conductive portion 44 of the first conductive layer 40. The position of the opening portion 54 is not particularly limited if only it is on the second conductive portion 44 and is separated from the second conductive layer 60 described more fully below. The shape of the opening portion 54 is not particularly limited so long as it is able to expose the first conductive layer 40 as the second conductive portion.

It is preferable that the position of the opening portion 54 should be out of the first area surface 33 in order to secure symmetric property of the oscillating plate 30. The distance from the first area surface 33 is defined by allowable wiring resistance.

A wiring layer 70 is not a component having influence on deformation of the oscillating plate 30 unlike the first conductive portion 43 and the second conductive portion 44, and thus an increase in film thickness for reducing the resistance value is not restricted. When there is a necessity to further reduce the resistance value, it is preferable that the wiring layer 70 should be provided as close as possible to the first area surface 33.

As viewed from the second direction 220, the second conductive layer 60 is successively formed to cover the piezoelectric layer 50 in the first direction 210 at least within the area overlapping with the first area surface 33. In addition, the second conductive layer 60 is formed to cover at least a part of the piezoelectric layer 50 while overlapping with a part of the first conductive layer 40 in the third direction 230. Moreover, as viewed from the second direction 220, the second conductive layer 60 has extending portions 65*a* and 65*b*, which extends toward both sides in the third direction 230, in at least a part of the area between the first conductive layers 40 adjacent to each other.

In the embodiment, as shown in FIGS. 2A and 2B, the second conductive layer 60 is formed to cover the piezoelectric layer 50 in the area overlapping with the first area surface 33 in the first direction 210 as viewed from the second direction 220. Further, in the embodiment, as shown in FIGS. 2A and 2C, as viewed from the second direction 220, the second conductive layer 60 has two sectional surfaces which are sectional surfaces 61 and 62 of the third direction 230 within the area overlapping with the first area surface 33. The sectional surfaces 61 and 62 are disposed, as viewed from the second direction 220, to overlap with the surface 42 of the first conductive layer 40. The two sectional surfaces 61 and 62 are sectional surfaces of the third direction 230 which are formed within the area overlapping with the first area surface 33 as viewed from the second direction 220 when the second conductive layer 60 is patterned. The sectional surface 61 is a sectional surface on the side on which the sectional surface 41 of the first conductive layer 40 is formed. In addition, the sectional surface 62 is a sectional surface on the side on which the opening portion 54 is formed. Further, in the embodiment, as shown in FIGS. 2A and 2C, as viewed from the second direction 220, the width of the second conductive layer 60 within the area overlapping with the first area surface 33 in the third direction 230 is smaller than the width of the first conductive portion 43 of the first conductive layer 40 in the third direction 230.

The second conductive layer 60 may be formed, as shown in FIGS. 2A and 2B, successively in the first direction 210 so as to cover each of the plurality of piezoelectric layers 50. Further, as shown in FIGS. 2A and 2B, the second conductive layer 60 is able to cover the surface 51 and the side surface 52 of each piezoelectric layer 50 in at least a part of the piezoelectric layer 50 in the first direction 210.

As shown in FIGS. 2A and 2C, the opening portion 63, in which the second conductive layer 60 is not provided, may be formed. The sectional surface 62 may constitute a part of the opening portion 63.

In the embodiment, as shown in FIGS. 2A and 2C, the second conductive layer 60 is formed so that the sectional surfaces 61 and 62 overlap with the surface 42 of the first conductive layer 40 within the area overlapping with the first area surface 33 as viewed from the second direction 220. As a result, as viewed from the second direction 220, a part of the area of the piezoelectric layer 50 within the area overlapping with the first area surface 33 is interposed between the first conductive portion 42 of the first conductive layer 40 and the second conductive layer 60. In this case, the area interposed between the first conductive layer 40 and the second conductive layer 60 in the piezoelectric layer 50 is defined as a driving area 55. As shown in FIGS. 2A and 2C, the position of one end portion 55*a* of the driving area 55 in the third direction 230 can be defined by the position of the sectional surface 61 of the second conductive layer 60. Further, the position of the other end portion 55*b* of the driving area 55 in the third direction 230 can be defined by the position of the sectional surface 62 of the second conductive layer 60. Consequently, it is possible to form the driving area 55 on the surface 42 of the first conductive portion 43 of the first conductive layer 40. In other words, the driving area 55 is not formed on the sectional surface 41 of the first conductive layer 40, but only on the first conductive portion 43 of the first conductive layer 40. As shown in FIGS. 2A and 2C, the second conductive layer 60 may be formed not to overlap with the first side 33*a* of the first area surface 33 as viewed from the second direction 220.

In the embodiment, as shown in FIGS. 2A and 2E, the extending portions 65*a* and 65*b* extend up to the outsides of the end portions (the first side 33*a* and the second side 33*b*) of the first area surface 33 in the third direction 230 as viewed from the second direction 220. Further, in the embodiment, as shown in FIGS. 2A and 2D, the extending portions 65*a* and 65*b* are provided at positions beyond the first area surfaces 33 as viewed from the second direction 220. In addition, in the example shown in FIGS. 2A and 2E, the extending portion 65*a* is elongated up to the inside of the area in which the piezoelectric layer 50 does not exist, but may be elongated up to the area overlapping with the piezoelectric layer 50.

In the embodiment, as shown in FIGS. 2A and 2E, the area (the area on which the driving area 55 of the piezoelectric element 100 is formed), in which the first conductive layer 40 overlaps with the second conductive layer 60, is provided, as viewed from the second direction 220, to be symmetric to the first direction 210 as an axis of symmetry in the range from one end of the first area surface 33 to the other end thereof in the third direction 230. Further, the extending portions 65*a* and 65*b* are formed, as viewed from the second direction 220, to be symmetric to the first direction 210 as an axis of symmetry in the range from one end of the first area surface 33 to the other end thereof in the third direction 230.

The second conductive layer 60 is electrically connected to a common electrode (not shown in the drawing), and thus a part of the extending portions 65*a* and 65*b* may be electrically connected to the common electrode at the extending tip thereof. In the example shown in FIGS. 2A and 2E, all the extending portions 65*b* are electrically connected to the common electrode at the extending tip.

Figure 2F:
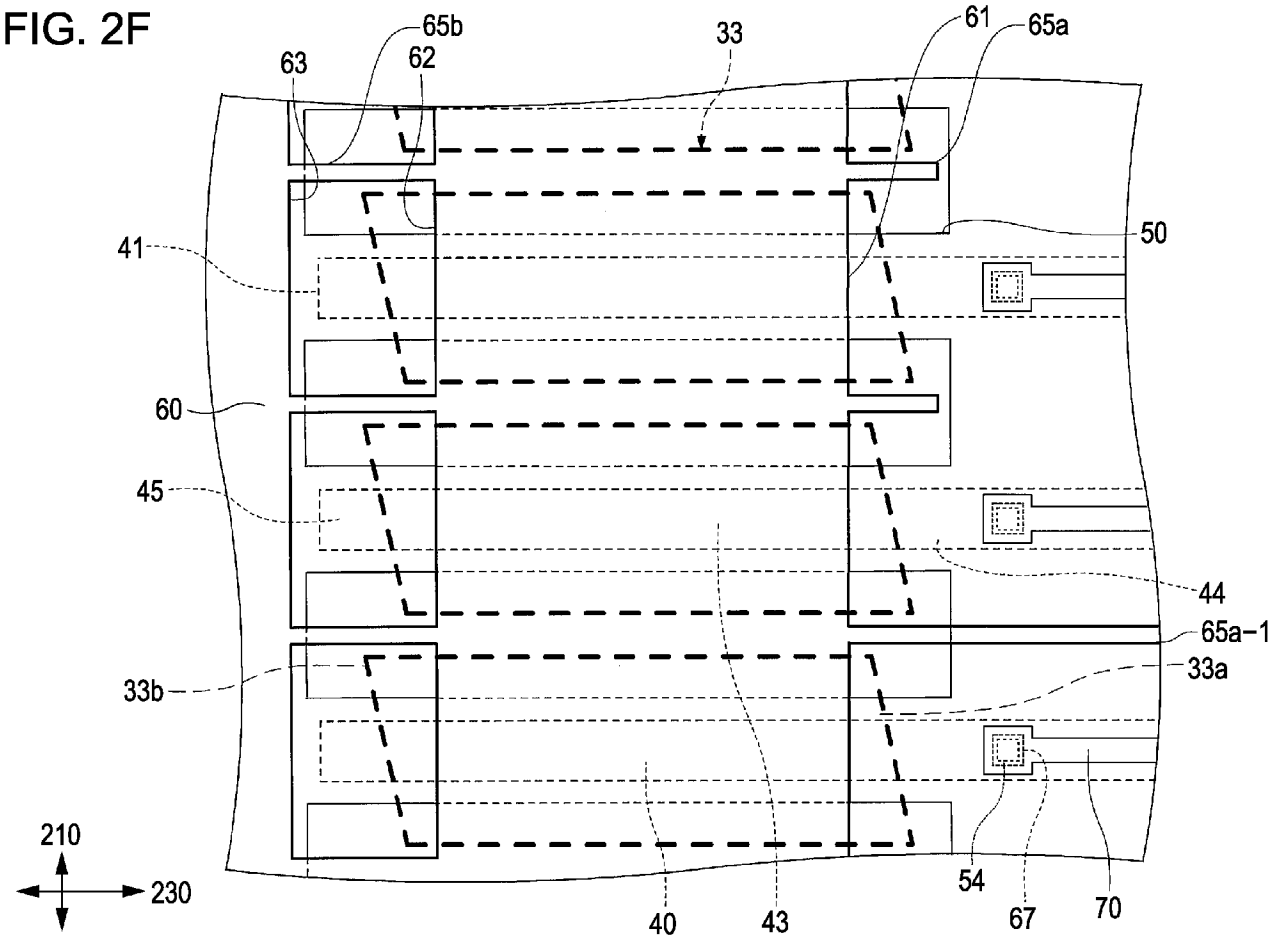
FIG. 2F is a top plan view schematically illustrating principal sections of a liquid droplet ejecting head according to a modified example of the first embodiment.

FIG. 2F is a top plan view schematically illustrating principal sections of a liquid droplet ejecting head according to a modified example of the embodiment. In the example shown in FIG. 2F, in addition to the extending portion 65*b*, the extending portion 65*a*-1, which is a part of the extending portions 65*a*, is electrically connected to the common electrode at the extending tip.

The structure and the material of the second conductive layer 60 are not particularly limited. For example, the second conductive layer 60 may be formed as a single layer. Alternatively, the second conductive layer 60 may be formed of a plurality of laminated films. The second conductive layer 60 is formed as a layer having conductivity, and constitutes the upper electrode in the piezoelectric element 100. The second conductive layer 60 may be, for example, a metal layer including platinum (Pt), iridium (Ir), gold (Au) and the like. Although not shown in the drawing, the second conductive layer 60 may be connected to, for example, the common electrode (not shown in the drawing) through the wire or may be connected thereto successively. The second conductive layer 60 is able to perfectly cover a portion including the driving area 55 of the piezoelectric layer 50 in the first direction 210. With such a configuration, it is possible to protect the piezoelectric layer 50 of the driving area 55 from being affected by external factors such as humidity (moisture) in the air.

The third conductive layer 67 may be formed, as shown in FIGS. 2A and 2C, to cover at least the opening portion 54. Further, the third conductive layer 67 may be formed to cover the second conductive portion 43 (the first conductive layer 40) in at least the opening portion 54 (not shown in the drawing). The structure and the material of the third conductive layer 67 are not particularly limited. The third conductive layer 67 may be formed similarly to the second conductive layer 60 if only it is formed as a layer having conductivity. In a manufacturing process, by forming the third conductive layer 67, it is possible to protect the surface of the second conductive portion 43 of the first conductive layer 40 in the opening portion 54. The detailed manufacturing method will be described more fully below. Further, since the third conductive layer 67 is not an essential component of the piezoelectric element 100 in the embodiment, the third conductive layer 67 may not be formed on the first conductive layer 40 in the opening portion 54 (not shown in the drawing).

The fourth conductive layer 70 is formed, as shown in FIGS. 2A and 2C, to be electrically connected to the third conductive layer 67. Consequently, the fourth conductive layer 70 is electrically connected to the first conductive portion 42 through the second conductive portion 43. The fourth conductive layer 70 may be formed to cover at least the opening portion 54. The shape of the fourth conductive layer 70 is not particularly limited so long as it is formed at least within the opening portion 54. The structure and the material of the fourth conductive layer 70 are not particularly limited. For example, the fourth conductive layer 70 may be formed as a single layer. Alternatively, the fourth conductive layer 70 may be formed of a plurality of laminated films. The fourth conductive layer 70 is formed as a layer having conductivity, and constitutes a lead wire to the lower electrode in the piezoelectric element 100. The fourth conductive layer 70 may be a metal layer including, for example, gold (Au), nickel-chromium alloy (Ni—Cr), platinum (Pt), iridium (Ir), copper (Cu), nickel (Ni), and the like. The fourth conductive layer 70 may be connected to an external driving circuit 95. Thereby, it is possible to electrically connect the first conductive layer 40 to, for example, the external driving circuit 95 through the fourth conductive layer 70.

It is preferable that the fourth conductive layer 70 and the common electrode should be made of the same material. The reason is that the bonding surfaces are preferably the same metal in the wire bonding and the FPC bonding for connecting the fourth conductive layer and the common electrode to the external driving circuit 95.

The first conductive layer and the second conductive layer are components that have influence on deformation of the oscillating plate 30. Thus, in order to obtain an appropriate amount of displacement and driving frequency of the oscillating plate 30, there is a limitation in the allowable range of film thickness. Hence, an increase in film thickness for the sake of reducing the resistance value has a limitation. For this reason, it is necessary for the conductive layer 70 and the common electrode to have resistance values which are reduced to the resistance values allowable at the time of driving by appropriately setting materials, sizes, and film thicknesses of those.

The liquid droplet ejecting head 300 according to the embodiment may have, as shown in FIG. 1, a sealing plate 90 capable of sealing the piezoelectric element 100. The sealing plate 90 has a sealing area 91 capable of sealing the piezoelectric element 100 in the predetermined space area. It is preferable that the sealing area 91 should be an area having a space adapted so that the oscillation motion of the piezoelectric element 100 is not disturbed. The structure and the material of the sealing plate 90 are not particularly limited. For example, the sealing plate 90 may be made of, for example, monocrystal silicon, nickel, stainless, stainless steel, glass ceramics, various resin materials, or the like. Further, the liquid droplet ejecting head 300 may have a casing that is made of, for example, various resin materials or various metal materials and are able to house the above-mentioned components (not shown in the drawing).

With several configurations mentioned above, the liquid droplet ejecting head 300 according to the embodiment can be configured.

The liquid droplet ejecting head 300 according to the embodiment has, for example, the following characteristics.

In the embodiment, the liquid droplet ejecting head 300 has the extending portions 65*a* and 65*b* which extend both sides in the third direction 230 in at least a part of the area between the first conductive layer 40 adjacent to each other as viewed from the second direction 220. Hence, it becomes easy to adjust the balance of stiffness in the third direction 230. Accordingly, it is possible to embody a liquid droplet ejecting head having improved durability.

Further, since the extending portions 65*a* and 65*b* extend up to the outsides of the end portions of the first area surface 33 in the third direction 33 as viewed from the second direction 220, it becomes easy to balance the stiffness in the third direction 230. Moreover, since the extending portions 65*a* and 65*b* are provided at the position not overlapping with the first area surface 33 as viewed from the second direction 220, the oscillation of the oscillating plate 30 becomes less likely to be disturbed.

Further, as shown in FIG. 2A, by arranging the extending portions 65*a* and 65*b* with the adjacent second conductive portions 44 and the adjacent third conductive portions 45 interposed therebetween, the upper electrodes adjacent to each other fulfill a fixing function. As result, it is possible to provide an effect of reducing crosstalk of the piezoelectric layers 50 adjacent to each other.

Further, the area in which the first conductive layer 40 overlaps with the second conductive layer 60, is provided, as viewed from the second direction 220, to be symmetric to the first direction 210 as an axis of symmetry in the range from one end of the first area surface 33 to the other end thereof in the third direction 230. In addition, the extending portions 65*a* and 65*b* are formed, as viewed from the second direction 220, to be symmetric to the first direction 210 as the axis of symmetry in the range from one end of the first area surface 33 to the other end thereof in the third direction 230. With such a configuration, the stiffness in the third direction 230 is substantially balanced.

Moreover, the second conductive layer 60 is electrically connected to the common electrode, and thus at least a part of the extending portions 65*a* and 65*b* may be electrically connected to the common electrode at the extending tip thereof. With such a configuration, it is possible to reduce the value of resistance between the second conductive layer 60 and the common electrode.

In addition, the ink jet type printing head, which ejects ink, has been described as an example of the liquid droplet ejecting head. However, the embodiment of the invention can be applied to overall liquid droplet ejecting heads and liquid droplet ejecting apparatuses using the piezoelectric element. The liquid droplet ejecting heads include, for example: a printing head used in image printing apparatuses such as a printer; a color material ejecting head used for manufacturing color filters of the liquid crystal display and the like; an electrode material ejecting head used for manufacturing electrodes of an organic EL (Electro Luminescence) display, an FED (Field Emission Display), and the like; and a bio-organic ejecting head used for manufacturing a bio chip.

1-2. Manufacturing Method

Hereinafter, referring to the accompanying drawings, a manufacturing method of the liquid droplet ejecting head 300 according to the embodiment will be described.

FIGS. 3 to 10 are sectional views illustrating a manufacturing method of the liquid droplet ejecting head 300 according to the embodiment.

The manufacturing method of the liquid droplet ejecting head according to the embodiment is different in accordance with whether the material used for forming the pressure chamber substrate 10 and the nozzle plate 20 is monocrystal silicon or stainless steel. In what follows, the manufacturing method of the liquid droplet ejecting head in the case of using the monocrystal silicon will be described. Accordingly, the manufacturing method of the liquid droplet ejecting head according to the embodiment is not limited to, particularly, the following manufacturing method, and may include a known electroforming process and the like when the nickel, stainless steel, stainless, or the like is used as a material thereof. Further, the procedure of each process is not limited to the following manufacturing method.

Figure 3A:
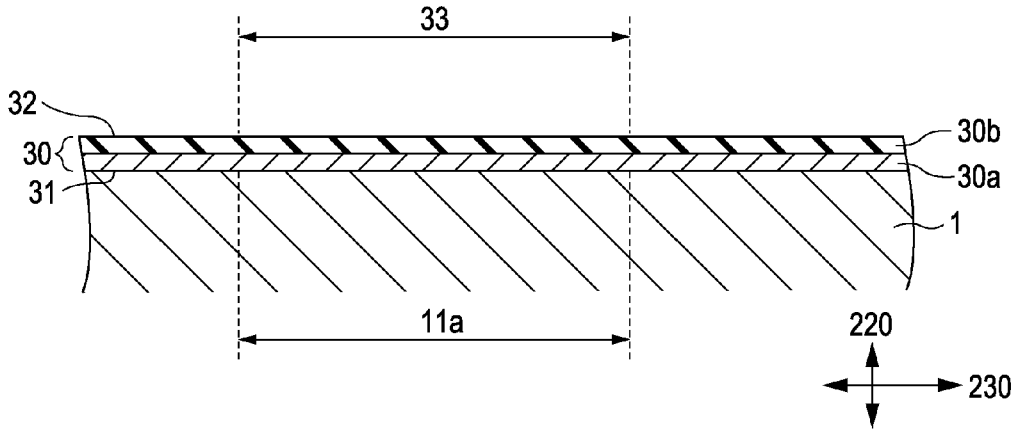
FIGS. 3A to 3C are sectional views schematically illustrating a manufacturing method of the liquid droplet ejecting head according to the first embodiment.

First, as shown in FIG. 3A, the oscillating plate 30 is formed on the substrate 1 made of the prepared monocrystal silicon. As shown in FIG. 3A, in the manufacturing process to be described later, the area, on which the pressure chamber 11 of the substrate 1, is defined as an area 11*a*. The oscillating plate 30 is formed by a known film formation technique. As shown in FIG. 3A, for example, the oscillating plate 30 may be formed as follows: an elastic layer 30*a* constituting the elastic plate is formed by the sputtering method or the like; and then an insulation layer 30*b* is formed on the elastic layer 30*a* by the sputtering method. For example, the elastic layer 30*a* may use zirconium oxide, and the insulation layer 30*b* may use silicon oxide. Here, the surface of the oscillating plate 30 facing toward the substrate 1 is defined as the first surface 31, and the surface opposite to the first surface 31 is defined as the second surface 32. Further, as viewed from the second direction 220, the area overlapping with the area 11*a* on the first surface 31 is defined as the first area surface 33.

Figure 3B:
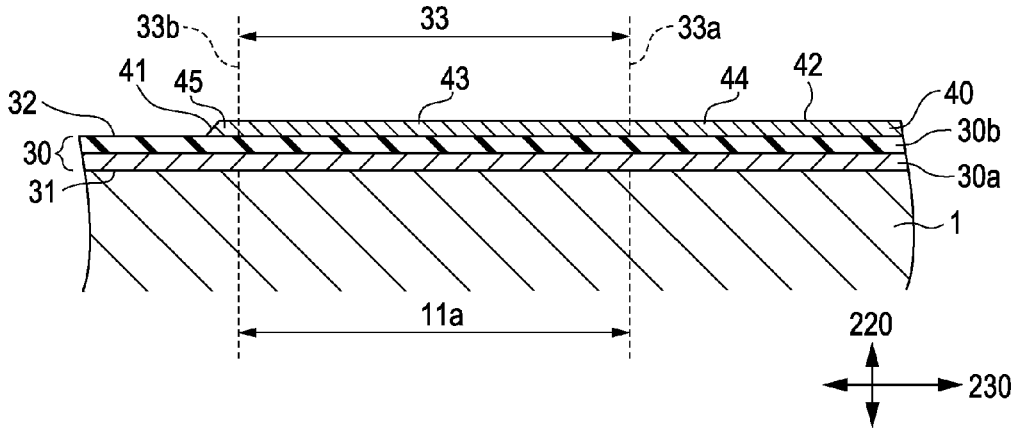

After the oscillating plate 30 is formed, as shown in FIG. 3B, a conductive layer is formed on the second surface 32 of the oscillating plate 30, and then is patterned by an etching, thereby forming the first conductive layer 40. Here, as viewed from the second direction 220, the first conductive layer 40 is patterned to cover the second surface 32 of the oscillating plate 30 while overlapping with the area 11*a* in the first direction 210, and to cover the second surface 32 of the oscillating plate 30 in an area beyond the area overlapping with the area 11*a* at least one side in the third direction 230.

When the first conductive layer 40 is patterned, as shown in FIG. 3B, the sectional surface 41 on one side in the third direction 230 is formed to have a tapered side surface. Thereby, the sectional surface 41 is formed. Further, the first conductive layer 40 is patterned, and simultaneously the surface 42 is formed. The position of the sectional surface 41 may be beyond the area overlapping with the first area surface 33 as viewed from the second direction 220, and although not shown in the drawing, may be in the area overlapping with the first area surface 33.

Here, as viewed from the second direction 220, the portion, which is formed in the area overlapping with the first area surface 33 in the first conductive layer 40, may be defined as the first conductive portion 43. In addition, the portion, which is formed to extend from the first side 33*a* of the area overlapping with the first area surface 33 in the portion formed beyond the area overlapping with the first area surface 33, may be defined as the second conductive portion 44. Further, the sectional surface 41 may be formed, as viewed from the second direction 220, beyond the area overlapping with the first area surface 33. In this case, the portion, which is formed to extend from the second side 33*b* of the area overlapping with the first area surface 33, is defined as the third conductive portion 45.

In addition, the detailed configuration of the first conductive layer 40 is the same as described above, and thus the description thereof will be omitted. The first conductive layer 40 may be formed by the known film formation technique. For example, the first conductive layer 40 may be formed as follows: the conductive layer (not shown in the drawing) is formed by laminating platinum, iridium, and the like in the sputtering method, and then the conductive layer is etched to be formed in a predetermined shape.

Figure 3C:
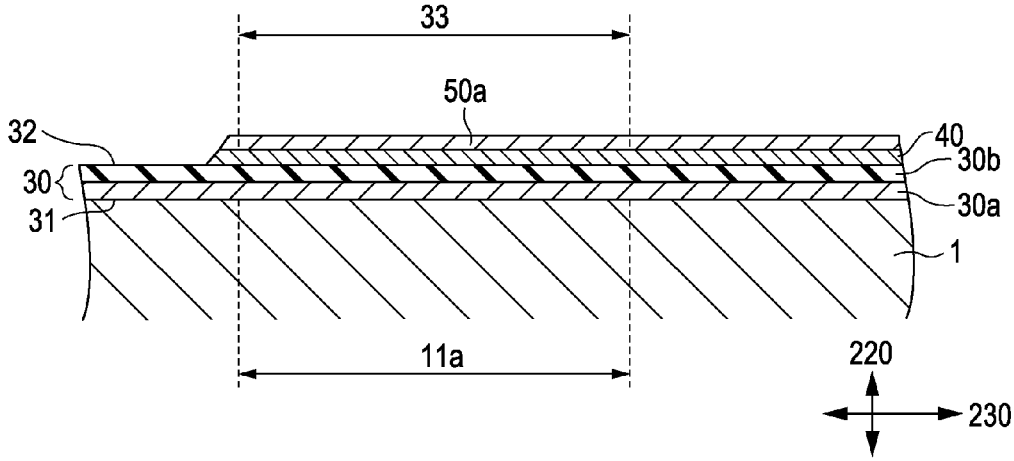

Here, as shown in FIG. 3C, before the conductive layer for forming the first conductive layer 40 is patterned by the etching, an etching protective film 50*a* may be formed on the corresponding conductive layer. The etching protective film 50*a* is a piezoelectric body which is made of a piezoelectric material the same as that of the piezoelectric layer 50. The etching protective film 50*a* may be formed in the area in which the first conductive layer 40 patterned in a desired shape is formed. With such a configuration, in the etching process of patterning the first conductive layer 40, it is possible to protect the surface of the first conductive layer 40 from being chemically damaged by the used etchant.

Figure 4A:
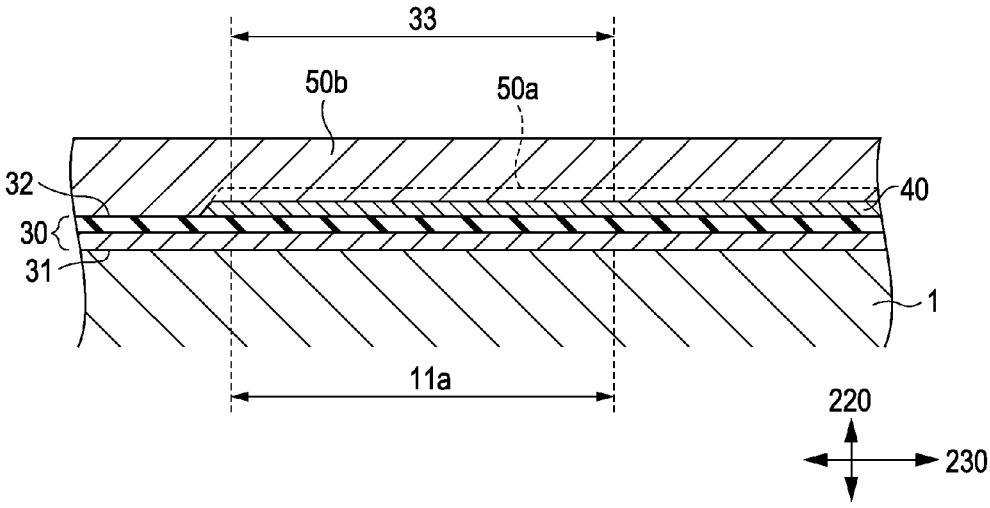
FIGS. 4A and 4B are sectional views schematically illustrating a manufacturing method of the liquid droplet ejecting head according to the first embodiment.

Next, as shown in FIG. 4A, a piezoelectric layer 50*b* is formed to cover the first conductive layer 40. By patterning the piezoelectric layer 50*b*, the piezoelectric layer 50 is formed. The detailed description will be given later. The piezoelectric layer 50*b* may be formed by the known film formation technique. For example, the piezoelectric layer 50*b* may be formed by coating the precursor, which is a known piezoelectric material, on the second surface 32 of the oscillating plate 30 and performing a heating treatment thereon. The used precursor is not particularly limited if only it is baked at a high temperature by the heating treatment and subsequently has piezoelectric characteristics by performing a polarization treatment thereon. For example, precursors such as lead zirconate titanate may be used. In addition, when the etching protective film 50*a* is formed, the etching protective film 50*a* is made of the same piezoelectric material as the piezoelectric layer 50*b* (the piezoelectric layer 50). Hence, after the baking, the etching protective film 50*a* can be integrated with the piezoelectric layer 50*b*.

Figure 4B:
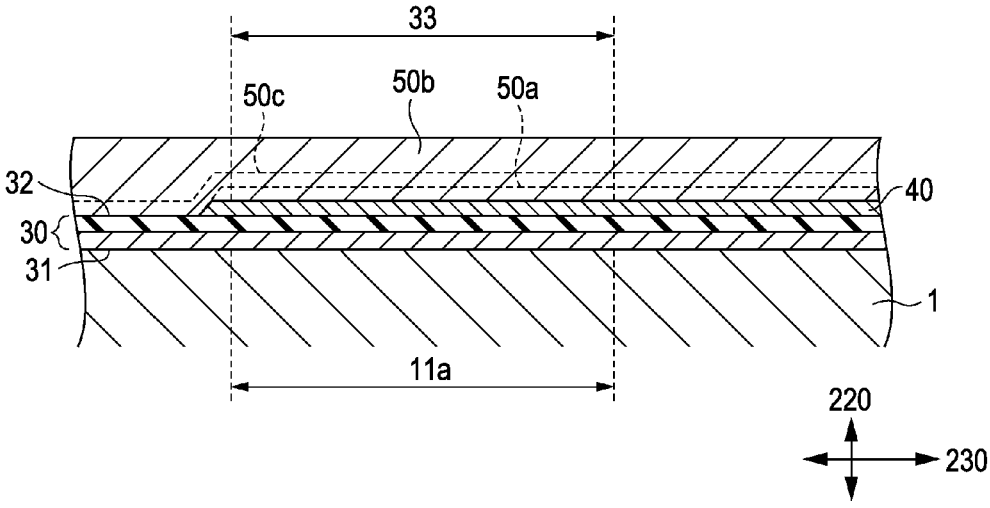

Here, for example, the piezoelectric layer 50*b* (the piezoelectric layer 50) may be made of lead zirconate titanate. In this case, as shown in FIG. 4B, after an intermediate titanium layer 50*c* made of titanium is formed on the whole second surface 32 of the oscillating plate 30, the precursor as the piezoelectric material may be coated thereon. In such a manner, when the piezoelectric layer 50*b* is subjected to crystal growth by performing the heating treatment on the precursor, the interfacial surface, on which the corresponding precursor crystals grow, can be unified as the intermediate titanium layer 50*c*. In other words, it is possible to remove the piezoelectric layer 50*b* in which crystals are grown on the oscillating plate 30. Thus, it is possible to increase controllability of the crystal growth of the piezoelectric layer 50*b*, and thus the piezoelectric layer 50*b* can be piezoelectric crystals having higher orientation. In addition, the intermediate titanium layer 50*c* can be incorporated into the crystals of the piezoelectric layer 50*b* at the time of the heating treatment.

Figure 5A:
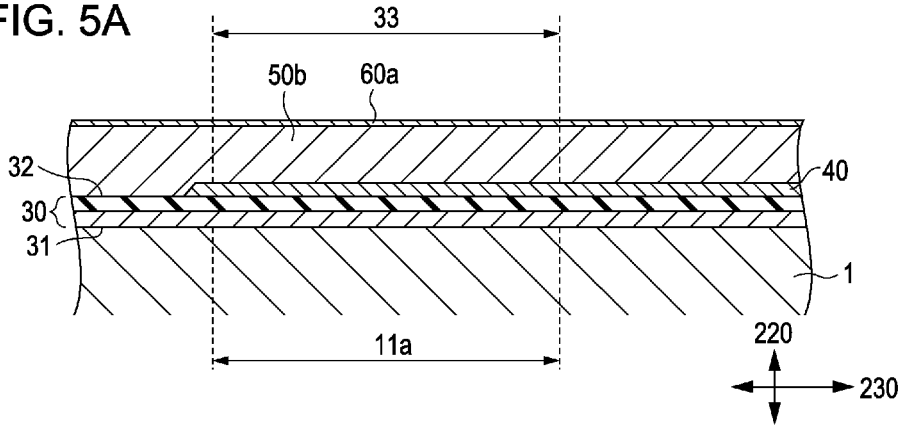
FIGS. 5A to 5C are sectional views schematically illustrating a manufacturing method of the liquid droplet ejecting head according to the first embodiment.
Figure 5B:
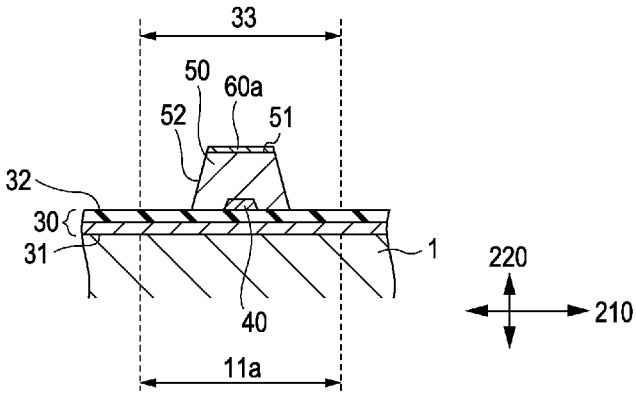

Next, as shown in FIG. 5A, before the piezoelectric layer 50*b* is patterned in a desired shape by the etching, a mask layer 60*a* having conductivity is formed to cover the piezoelectric layer 50*b*. The mask layer 60*a* is a metal layer made of the same material as a conductive layer 60*b* to be described later. As shown in FIG. 5B, after the mask layer 60*a* is formed, the piezoelectric layer 50*b* is patterned by the etching, and thereby the piezoelectric layer 50 is patterned in a desired shape. Here, by forming the mask layer 60*a*, the mask layer 60*a* functions as a hard mask in the etching process. Thus, as shown in FIG. 5B, it is possible to easily form the tapered side surface 52 on the piezoelectric layer 50. In addition, the detailed configuration of the piezoelectric layer 50 is the same as described above, and thus the description thereof will be omitted.

Figure 5C:
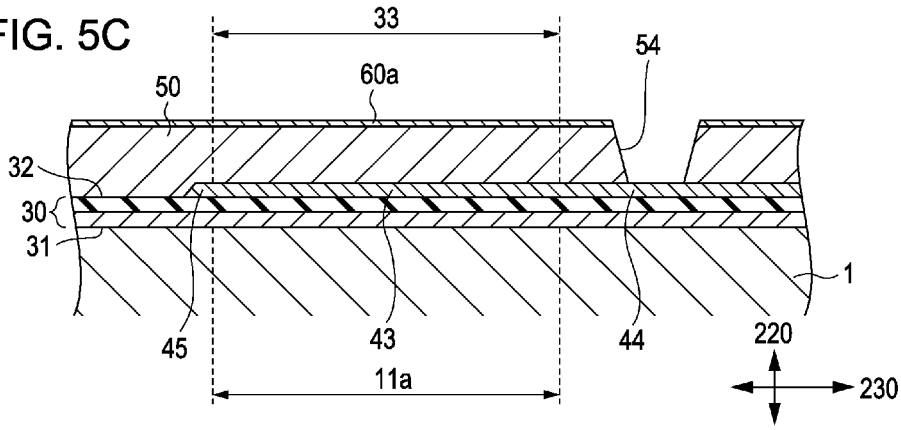

As shown in FIG. 5C, when the piezoelectric layer 50 is etched, the opening portion 54, which exposes the first conductive layer 40, is formed on the second conductive portion 43 of the first conductive layer 40 at the same time. The opening portion 54 is formed to be separated from the second conductive layer 60 on the second conductive portion 43.

Figure 6:
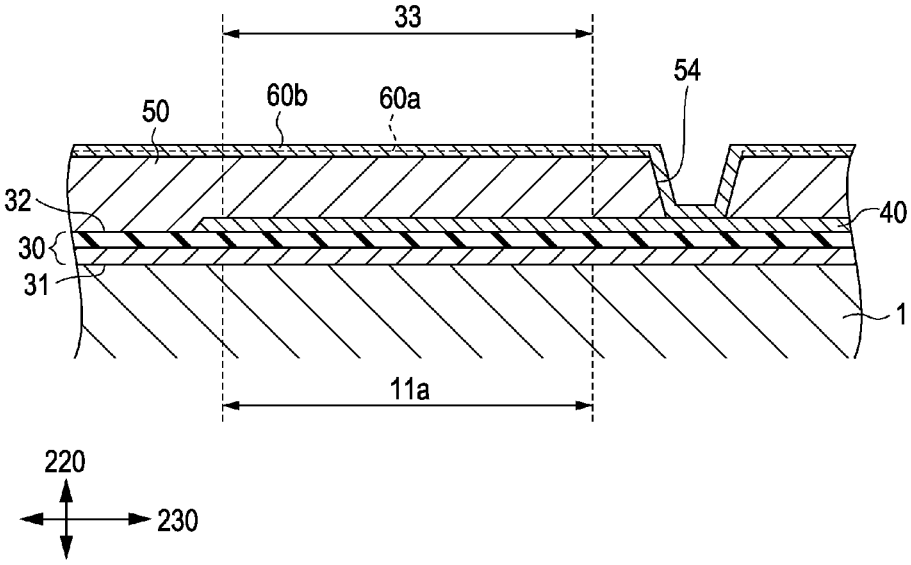
FIG. 6 is a sectional view schematically illustrating a manufacturing method of the liquid droplet ejecting head according to the first embodiment.

Subsequently, as shown in FIG. 6, the conductive layer 60*b* is formed to cover the piezoelectric layer 50 and the opening portion 54. Accordingly, the conductive layer 60*b* is made of the same material as the second conductive layer 60. The conductive layer 60*b* may be formed by the known film formation technique. For example, the conductive layer 60*b* may be formed by laminating platinum, iridium, and the like in the sputtering method or the like. In addition, when the mask layer 60*a* is formed, the mask layer 60*a* employs the same piezoelectric material as the conductive layer 60*b*. Hence, the mask layer 60*a* can be integrated with the conductive layer 60*b*.

Figure 7:
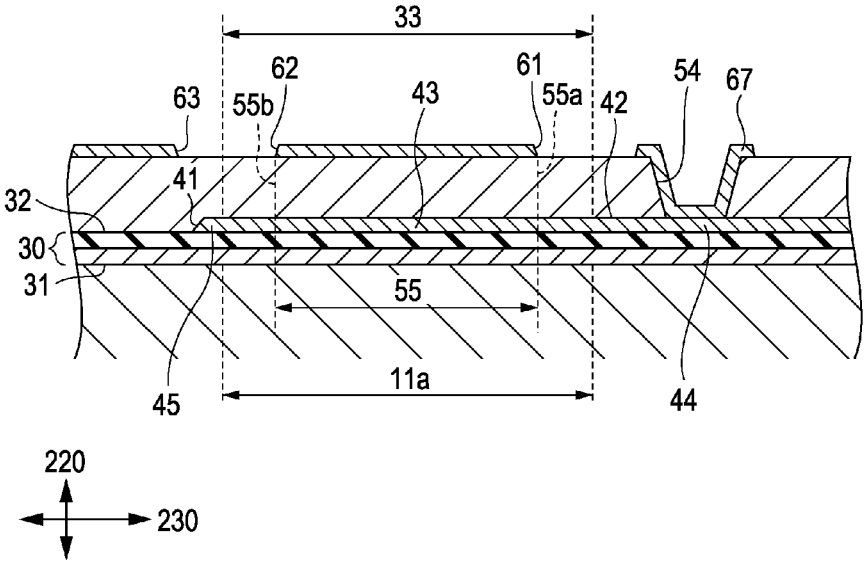
FIG. 7 is a sectional view schematically illustrating a manufacturing method of the liquid droplet ejecting head according to the first embodiment.

Next, as shown in FIG. 7, the conductive layer 60*b* is patterned in a desired shape by the etching, thereby forming the second conductive layer 60. In the process of patterning the conductive layer 60*b*, as shown in FIG. 7, as viewed from the second direction 220, the conductive layer 60*b* is patterned to overlap with the first conductive layer 40 in the first direction 210 at least within the area overlapping with the first area surface 33, and is patterned to cover at least a part of the piezoelectric layer 50 while overlapping with a part of the first conductive layer 40 in the third direction 230. Further, in the process of patterning the conductive layer 60*b*, as viewed from the second direction 220, the conductive layer 60*b* is patterned to cover the plurality of first conductive layers 40. Moreover, in the process of patterning the conductive layer 60*b*, as shown in FIGS. 2A and 2E, as viewed from the second direction 220, the second conductive layer 60 is in at least a part of the area between the first conductive layers 40, and thus the conductive layer 60*b* is patterned to have the extending portions 65*a* and 65*b* which extend both sides in the third direction 230.

Further, the second conductive layer 60 is successively formed to cover the plurality of piezoelectric layers 50. With such a configuration, the second conductive layer 60 may be connected to the common electrode through, for example, a wire which is not shown. In this case, the second conductive layer 60 can be used as a common upper electrode of the piezoelectric element 100. In addition the detailed configuration of the second conductive layer 60 is the same as described above, and thus the description thereof will be omitted. As described above, by patterning the second conductive layer 60, the driving area 55 of the piezoelectric layer 50 can be defined as the surface 42 of the first conductive layer 40 on the basis of the arrangement of the sectional surfaces 61 and 62.

Further, in the process of patterning the second conductive layer 60, as shown in FIG. 7, the conductive layer 60*b* may be patterned to cover the opening portion 54. Consequently, by not removing the conductive layer 60*b* formed above the opening portion 54, the third conductive layer 67 may be formed. With such a configuration, for example, after a resist is coated, a resist film may be formed by performing the exposure process and the development process, and the etching may be performed by using the resist film as a mask. In this case, an organic alkali developing solution, an organic remover solution, a cleaning solution, and the like are used therein. Accordingly, by not removing the conductive layer 60*b* formed above the opening portion 54 (in other words, by forming the third conductive layer 67), the surface of the first conductive layer 40 within the opening portion 54 is less likely to be over-etched. Further, it is possible to prevent the exposed portion of the first conductive layer 40 within the opening portion 54 from being chemically damaged by the organic remover solution and the cleaning solution after the etching. In addition, in the manufacturing method according to the embodiment, the third conductive layer 67 is not an essential component, and the third conductive layer 67 may be omitted by removing the conductive layer 60*b* in the opening portion 54.

Figure 8:
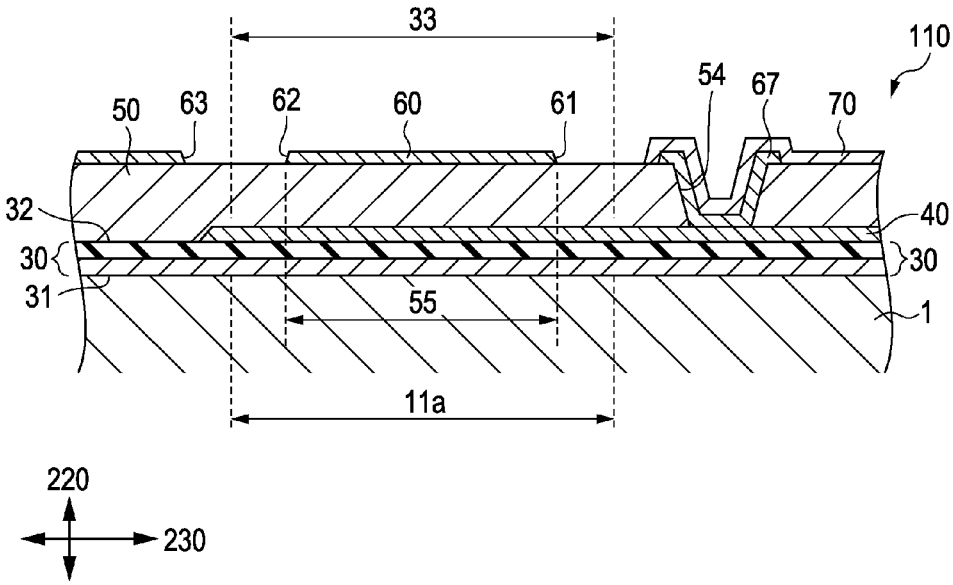
FIG. 8 is a sectional view schematically illustrating a manufacturing method of the liquid droplet ejecting head according to the first embodiment.

Next, as shown in FIG. 8, the fourth conductive layer 70 is formed to cover at least the opening portion 54. When the third conductive layer 67 is formed, the fourth conductive layer 70 may be electrically connected to the third conductive layer 67. The fourth conductive layer 70 may be formed by the known film formation technique. For example, the fourth conductive layer 70 may be formed as follows: a conductive layer (not shown in the drawing) is formed by laminating gold, nickel chromium alloy, or the like in the sputtering method, and the corresponding conductive layer is etched to be formed in a predetermined shape. The fourth conductive layer 70 may be connected to the external driving circuit which is not shown in the drawing.

Figure 9A:
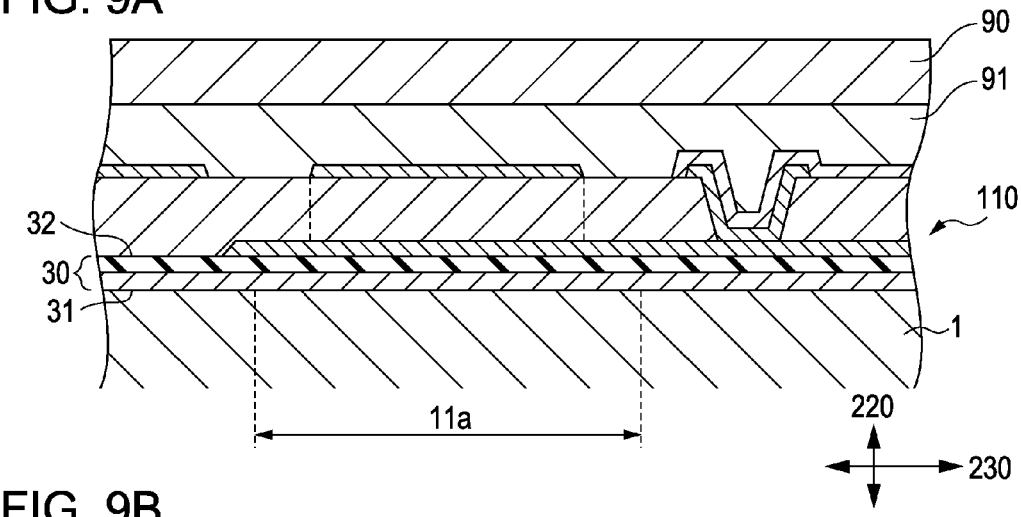
FIGS. 9A to 9C are sectional views schematically illustrating a manufacturing method of the liquid droplet ejecting head according to the first embodiment.
Figure 9B:
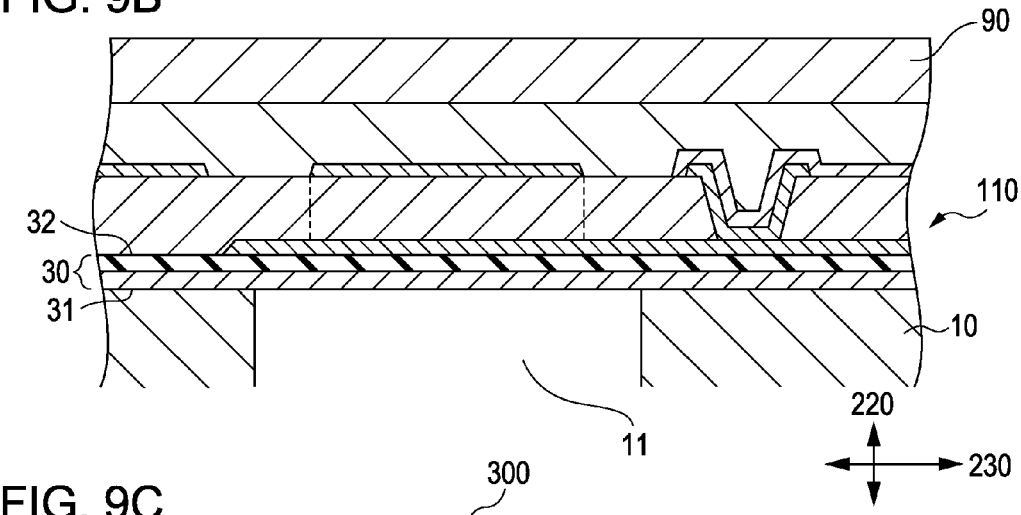
Figure 9C:
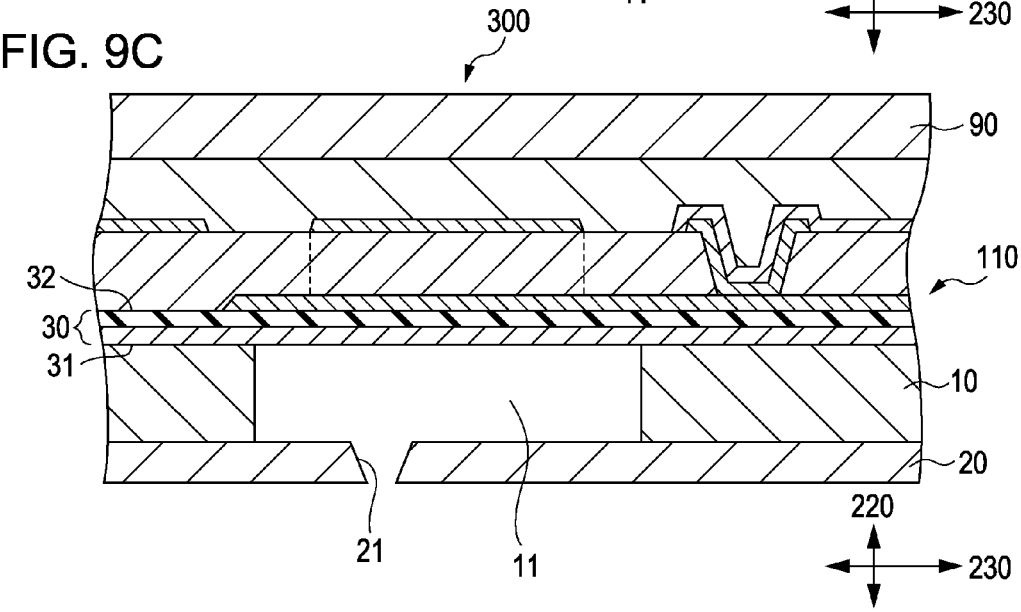

As shown in FIG. 9A, the sealing plate 90, in which the sealing area 91 is formed, is mounted above the piezoelectric element 100. Here, the piezoelectric element 100 may be sealed in the sealing area 91. The sealing plate 90 may seal the piezoelectric element 100 by using, for example, an adhesive. Next, as shown in FIG. 9B, by reducing the thickness of the substrate 1 to a predetermined thickness, the pressure chambers 11 and the like are partitioned. For example, the mask (not shown in the drawing) is formed on a surface opposed to the surface, on which the oscillating plate 30 is formed, so as to be patterned in a desired shape, on the substrate 1 having the predetermined thickness, and then the etching process is performed thereon, thereby forming the pressure chambers 11 and partitioning the wall portions 12, the supply passages 13, the communication passages 14, and the reservoirs 15 (not shown in the drawing). In such a manner, the pressure chamber substrate 10 having the pressure chambers 11 is formed below the oscillating plate 30. After the pressure chamber substrate 11 is formed, as shown in FIG. 9C, the nozzle plate 20 having the nozzle orifices 21 is bonded to a predetermined position by for example an adhesive. Thereby, the nozzle orifices 21 are communicated with the pressure chambers 11.

By using the several methods mentioned above, it is possible to manufacture the liquid droplet ejecting head 300. In addition, as described above, the manufacturing method of the liquid droplet ejecting head 300 is not limited to the above-mentioned manufacturing method, and the pressure chamber substrate 10 and the nozzle plate 20 may be formed by the electroforming method.

2. Liquid Droplet Ejecting Apparatus

Figure 10:
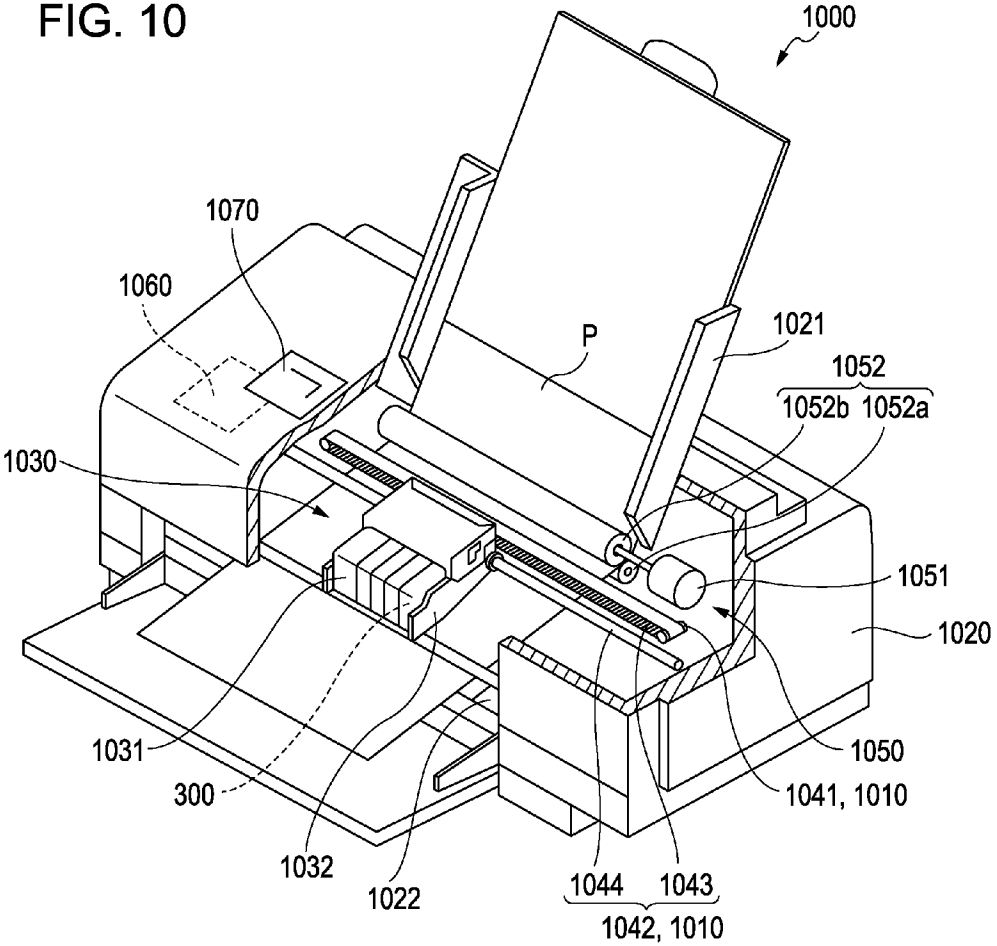
FIG. 10 is a perspective view schematically illustrating a liquid droplet ejecting apparatus according to the first embodiment.

Next, a liquid droplet ejecting apparatus according to the embodiment will be described. The liquid droplet ejecting apparatus according to the embodiment has the liquid droplet ejecting head according to the embodiment of the invention. Description is herein given of the case of the liquid droplet ejecting apparatus according to the embodiment 1000 as an ink jet printer. FIG. 10 is a perspective view schematically illustrating the liquid droplet ejecting apparatus 1000 according to the embodiment.

The liquid droplet ejecting apparatus 1000 includes: a head unit 1030; a driving section 1010; and a control section 1060. Further, the liquid droplet ejecting apparatus 1000 may include: an apparatus main body 1020; a sheet feeding section 1050; a tray 1021 on which a printing paper P is provided; a discharge port 1022 through which the printing paper P is discharged; and an operational panel 1070 which is disposed on a surface of the apparatus main body 1020.

The head unit 1030 has, for example, an ink jet type printing head (hereinafter simply referred to as a "head") formed of the above-mentioned liquid droplet ejecting head 300. The head unit 1030 further has an ink cartridge 1031 which supplies ink to the head, and a transport section (carriage) 1032 which is equipped with an ink cartridge 1031.

The driving section 1010 is able to reciprocate the head unit 1030. The driving section 1010 has a carriage motor 1041 which is a driving source of the head unit 1030, and a reciprocating mechanism 1042 which reciprocates the head unit 1030 by rotation of the carriage motor 1041.

The reciprocating mechanism 1042 includes a carriage guide shaft 1044 of which both ends are supported by a frame (not shown in the drawing), and a timing belt 1043 which extends in parallel to the carriage guide shaft 1044. The carriage guide shaft 1044 supports the carriage 1032 while freely reciprocating the carriage 1032. Moreover, the carriage 1032 is fixed at a part of the timing belt 1043. The operation of the carriage motor 1041 drives the timing belt 1043, and then the head unit 1030 reciprocates along the carriage guide shaft 1044. At the time of the reciprocating motion, the appropriate amount of the ink is ejected from the head, thereby performing the printing on the printing paper P.

The control section 1060 is able to control the head unit 1030, the driving section 1010, and the sheet feeding section 1050.

The sheet feeding section 1050 is able to send the printing paper P from the tray 1021 to the head unit 1030. The sheet feeding section 1050 includes a sheet feeding motor 1051 which is a driving source thereof, and a sheet feeding roller 1052 which is rotated by the operation of the sheet feeding motor 1051. The sheet feeding roller 1052 includes a driven roller 1052*a* and a driving roller 1052*b* which are vertically opposed to each other with a feeding path of the printing paper P interposed therebetween. The driving roller 1052*b* is connected to the sheet feeding motor 1051. When the sheet feeding section 1050 is driven by the control section 1060, the printing paper P is sent to pass the lower side of the head unit 1030.

The head unit 1030, the driving section 1010, the control section 1060, and the sheet feeding section 1050 are provided in the apparatus main body 1020.

The liquid droplet ejecting apparatus 1000 is able to have the liquid droplet ejecting head 300 of which durability is improved. Hence, it is possible to obtain the liquid droplet ejecting apparatus 1000 having improved durability.

In addition, in the above-mentioned example, the description has been given of the case where the liquid droplet ejecting apparatus 1000 is an ink jet printer, the printer according to the embodiment of the invention may be used as an industrial liquid droplet ejecting apparatus. In this case, the used liquid (the liquid material) for ejection may be a liquid in which various functional materials are adjusted to an appropriate viscosity by using solvating media and dispersion media, a liquid which include metal flakes, or the like.

Although the embodiment of the invention has been given as described above in detail, it should be understood by those skilled in the art that the foregoing and various other changes, omissions and additions may be made without departing from the new scope and effect of the invention. Therefore, the invention should be understood to include all possible modified examples.

What is claimed is:

1. A liquid droplet ejecting head comprising:

a pressure chamber substrate provided with a pressure chamber communicating with a nozzle orifice, wherein a plurality of the pressure chambers are arranged on the pressure chamber substrate in a first direction;

an oscillating plate that has a first surface and a second surface opposed to the first surface, wherein the first surface covers the pressure chamber as viewed from a second direction which is orthogonal to the first direction and is a normal direction of the first surface;

a plurality of first conductive layers formed, as viewed from the second direction, to cover the second surface of the oscillating plate within an area overlapping with the first area surface in the first direction, and to cover the second surface of the oscillating plate by extending up to the outside of the area overlapping with the first area surface on at least one side in a third direction orthogonal to the first direction and the second direction;

a piezoelectric layer formed, as viewed from the second direction, to cover the first conductive layer in at least the area overlapping with the first area surface; and a second conductive layer continuously formed, as viewed from the second direction, to cover the piezoelectric layer in the first direction at least within the area overlapping with the first area surface, and being formed to cover at least a part of the piezoelectric layer while overlapping with a part of the plurality of first conductive layers in the third direction, and having, as viewed from the second direction, extending portions, which extend toward both sides in the third direction, in at least a part of an area between adjacent first conductive layers, wherein the extending portions are provided, as viewed from the second direction, at positions which do not overlap with the first area surface.

2. The liquid droplet ejecting head according to claim 1, wherein the extending portions extend, as viewed from the second direction, beyond end portions of the first area surface in the third direction.

3. The liquid droplet ejecting head according to claim 1, wherein areas, in which the first conductive layers overlap with the second conductive layer, are formed, as viewed from the second direction, to be symmetric to the first direction as an axis of symmetry in the range from one end of the first area surface to the other end thereof in the third direction, and wherein the extending portions are formed, as viewed from the second direction, to be symmetric to the first direction as the axis of symmetry in the range from the one end of the first area surface to the other end thereof in the third direction.

4. The liquid droplet ejecting head according to claim 1, wherein the second conductive layer is electrically connected to the common electrode, and wherein at least a part of the extending portions is electrically connected to the common electrode at an extending tip.

5. The liquid droplet ejecting head according to claim 1, wherein an area, in which the piezoelectric layer does not exist, is provided in at least a part of the area between the first area surfaces adjacent to each other as viewed from the second direction.

6. A liquid droplet ejecting apparatus comprising the liquid droplet ejecting head according to claim 1.

* * * * *